US005109574A

United States Patent [19]

Eichenberger

[11] Patent Number: 5,109,574

[45] Date of Patent: May 5, 1992

[54] COMB SEGMENT FOR FIXING ON A COMB ROLLER OF A COMBING MACHINE

[75] Inventor: Hansulrich Eichenberger, Winterthur, Switzerland

[73] Assignee: Rieter Machine Works, Ltd., Winterthur, Switzerland

[21] Appl. No.: 354,929

[22] Filed: May 22, 1989

[30] Foreign Application Priority Data

May 20, 1988 [CH] Switzerland ..... 01941/88

[51] Int. Cl.[5] ..... D01G 19/04

[52] U.S. Cl. ..... 19/234; 19/233; 19/215

[58] Field of Search ..... 19/215, 216, 217, 225, 19/233, 234

[56] References Cited

U.S. PATENT DOCUMENTS

| | | | |
|---|---|---|---|
| 864,197 | 8/1907 | Rooney | 19/215 |
| 1,141,673 | 6/1915 | Whitin | 19/215 |
| 1,224,985 | 5/1917 | Whitin | 19/234 |
| 1,316,376 | 9/1919 | Maynard et al. | 19/234 |
| 1,382,893 | 6/1921 | Clegg | 19/234 |
| 1,493,201 | 5/1924 | Horridge | 19/234 |
| 1,620,031 | 3/1927 | Lanning | 19/234 |
| 1,892,317 | 12/1932 | Nasmith | 19/234 |
| 2,605,512 | 8/1952 | Wilson et al. | 19/234 |
| 2,633,606 | 4/1953 | Ferguson | 19/234 |
| 3,135,024 | 6/1964 | Nydam | 19/234 |
| 3,585,706 | 6/1971 | Moriwaki | 29/423 |
| 4,075,738 | 2/1978 | Egerer | 19/234 |
| 4,394,789 | 7/1983 | Egerer | 19/97 |

FOREIGN PATENT DOCUMENTS

| | | |
|---|---|---|
| 66624 | 4/1892 | Fed. Rep. of Germany . |
| 3336876 | 4/1985 | Fed. Rep. of Germany . |
| 1209190 | 2/1960 | France . |
| 26411 | 12/1967 | Japan . |
| 0274698 | 7/1927 | United Kingdom . |
| 2046805 | 11/1980 | United Kingdom . |

*Primary Examiner*—Werner H. Schroeder
*Assistant Examiner*—Michael A. Neas
*Attorney, Agent, or Firm*—Kenyon & Kenyon

[57] ABSTRACT

The circular comb segment is constructed to leave a large free space at the front edge to avoid deflecting a tuft delivered from a nipper unit away from the foremost needles or clothing points at the front edge. The comb segment may be provided with recesses at the sides of the front edge to receive screws for fixing the segment to a comb roller or may be provided with projecting lugs for securement to a comb roller. In one embodiment, the lugs may be replaced by clamping plates which engage against a reduced lip at the front edge of the segment or engaged within a recess or groove at the front edge. In still another embodiment, the comb segment may be provided with an inwardly offset projection to be received in a recess of the roller and secured therein.

15 Claims, 3 Drawing Sheets

Prior Art FIG. 1
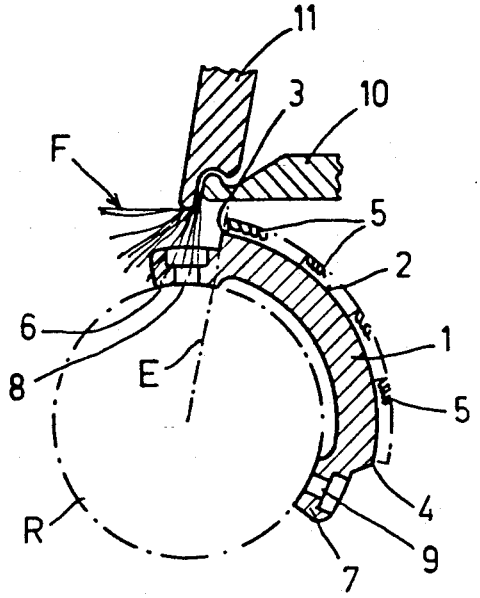
FIG. 3
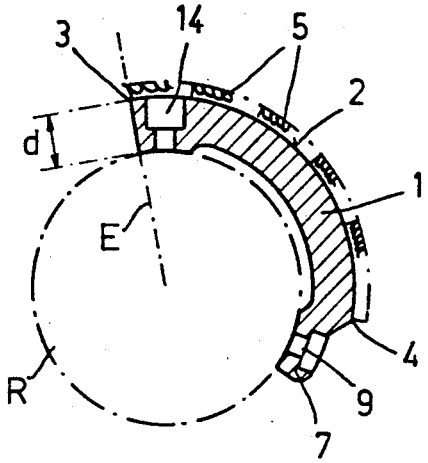
Prior Art FIG. 2
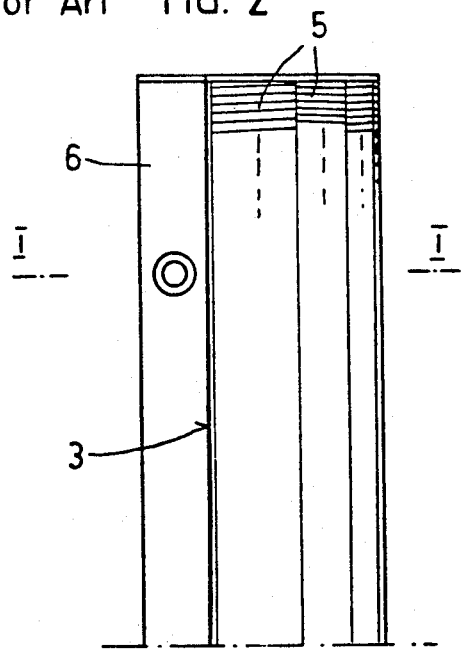
FIG. 4
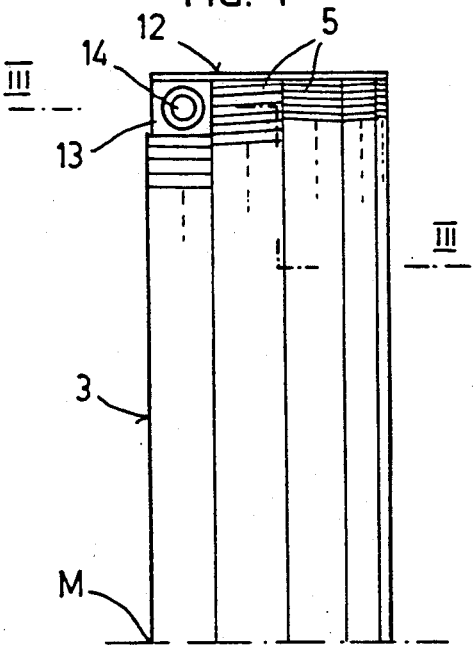

COMB SEGMENT FOR FIXING ON A COMB ROLLER OF A COMBING MACHINE

This invention relates to a comb segment for fixing on a comb roller of a combing machine.

As is known, combing machines have been constructed with rotatable circular combs having individual comb segments secured thereon. During rotation of the circular comb a nipper unit presents tufts to the individual segments for combing. In modern combing machines, a circular comb can rotate at speeds of up to about 300 rpm and the lap for combing can be fed to the nipper unit at a mean speed of up to approximately 2 meters per minute and in a weight of up to about 230 grams per square meter (m), i.e. up to about 4.5 g lap per minute per centimeter (cm) width of the circular comb. However, attempts to increase the production still further by increasing the speed and/or increasing the lap weight have not been successful since the tuft presented to the circular comb segment has not been combed satisfactorily and completely.

The known circular comb segments generally comprise a base, usually made by drawing, on which projecting strips are formed, one in front of the front edge and one behind the rear edge of the outer peripheral surface, with bores in each strip to receive screws which are screwed into a circular comb roller to fix the circular comb segment on the roller. By way of example, UK Patent Application 2,046,805; German OS 3336876; British Patent 274698 and French Patent 1,209,190 describe comb segments of such a type of construction.

It has now been found that with the known circular comb segments, the front fixing strip of the base which projects beyond the front edge of the outer peripheral surface and hence also beyond the foremost combing needles or clothing points, prevents any increase in production. The front fixing strip comes into contact with the fibers of the tuft presented to the circular comb segment before the fibers are engaged by the foremost combing needles or clothing points. If the speed and/or lap weight are now increased, the front fixing strip may radially push or throw some of the fibers away to such an extent that the tuft is no longer completely pierced by the combing needles or clothing points and drawn into the circular comb segment.

Accordingly, it is an object of the invention to provide a circular comb segment which permits increased production in a combing machine.

It is another object of the invention to be able to completely and satisfactorily comb a tuft at relatively high speed on a combing roll.

It is another object of the invention to be able to completely and satisfactorily comb a tuft having a relatively large lap weight.

Briefly, the invention provides a circular comb segment for fixing on a circular comb roller of a combing machine which includes a base having an outer cylindrical peripheral surface extending from a front edge to a rear edge for receiving combing needles or a clothing. In addition, the base has a free space in a peripheral direction in front of a plane passing through the axis of the cylindrical peripheral surface and through the front edge. This free space extends radially from the front edge at least over the major part of the thickness of the base and extends in the direction of the width of the base from the middle of the front edge to both sides over at least the major part of the width of the base.

The hitherto conventional continuous front fixing strip on the base is thus eliminated. The base must therefore be fixed in the region of the front edge in a different way from that previously known. There are various possibilities for this. In the preferred types of fixation, the free space in front of the segment extends over the entire thickness and/or over the entire width of the base.

These and other objects and advantages of the invention will become more apparent from the following detailed description taken in conjunction with the accompanying drawings wherein:

FIG. 1 illustrates a cross sectional view of a known circular comb segment taken on line I—I of FIG. 2;

FIG. 2 illustrates a plan view of the known comb segment of FIG. 1;

FIG. 3 illustrates a cross sectional view of a circular comb segment constructed in accordance with the invention and taken on line III—III of FIG. 4;

FIG. 4 illustrates a part plan view of the comb segment of FIG. 3;

Figure 5:
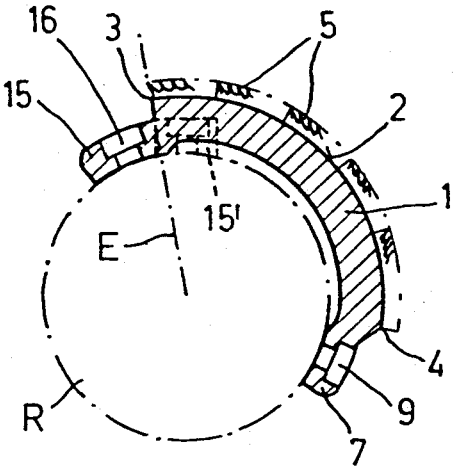
FIG. 5 illustrates a cross sectional view taken on line V—V of FIG. 6 of a modified comb segment in accordance with the invention.

Of note, the plan views of FIGS. 2, 4, 6, 8, 10 and 12 each show only one half of the circular comb segment; the other half being symmetrical to the half shown.

Referring to FIGS. 1 and 2, the known circular comb segment is formed of a base 1 having an outer peripheral surface 2 extending in the form of a segment of a cylinder from a front edge 3 to a rear edge 4. The outer peripheral surface 2 is provided with combing needles or a clothing 5. As indicated, the front edge 3 together with a flat front face of the base 1 is a radial plane E which passes through the axis of the cylinder segment as well as of the combing roller R. The circular comb segment is fixed on the roller R by means of screws (not shown) which are threaded into threaded bores in the roller R. To this end, the circular comb segment has a fixing strips 6, 7 extending from the base 1 at the front edge 3 and at the rear edge 4. Each strip 6, 7 extends over the entire width of the base and each contains two bores 8, 9, respectively through which screws (not shown) may be passed for fixing the comb segment on the roller R.

As indicated in FIG. 1, the circular comb segment cooperates with a nipper unit which consists of a lower nipper 10 and an upper nipper 11. On each rotation of the comb roller R, the nipper unit presents a tuft F of a lap (not shown) which is fed to the nipper unit directly to the circular comb segment.

In the known circular comb segment shown in FIGS. 1 and 2, it has been found that a tuft F is no longer satisfactorily combed by the circular comb segment if higher speeds and/or higher lap weights than conventional are used. It has been found that a basic cause of the the phenomenon is in the front fixing strip 6. That is, it has been found that the front fixing strip 6 comes into contact with the tuft F before the fibers are engaged by the front combing needles or clothing points 5. Some of the fibers of the tuft F, can, as a result, be pushed outwards to such an extent, as shown in FIG. 1, that the tuft F is no longer completely pierced by the front combing needles or clothing points 5.

Referring to FIGS. 3 and 4, wherein like reference characters indicate like parts as above, the circular comb segment has a base 1 with an outer cylindrical peripheral surface extending from a front edge 3 to a rear edge 4 for receiving combing needles or a clothing. In this case, a free space is provided in the peripheral direction in front of the plane E passing through the axis of the peripheral surface and through the front edge 3. This free space extends radially from the front edge 3 over the thickness d of the base 1 and extends in the direction of the width of the base 1 from the middle M (see FIG. 4) of the front edge 3 to both sides over the width of the base 1. This free space ensures that the tuft presented to the circular comb segment is completely pierced by the foremost combing needles or clothing points 5 which still project forwardly beyond the plane E and is drawn into the circular comb.

As indicated in FIG. 3, the rear fixing strip 7 is retained along with the bores 9 for fixing of the base 1 to the roller R.

As indicated in FIG. 4, the base 1 is provided with a recess 13 at each side 12 adjacent the front edge 3 with a bore 14 extending through each recess 13 for passage of a fixing screw (not shown) therethrough into the circular comb roller R.

Because of the recesses 13, the foremost row of clothing 5 does not extend over the entire width of the base 1. However, since the recesses 13 are disposed completely on the outside adjacent the side edges 12 and do not occupy more than 5% of the width of the base each, this does not have any detrimental effect. Instead, the free space in front of the plane E, that is, in front of the front edge 3, extends both radially from the front edge 3 over the full thickness d of the base 1 and also in the direction of the width of the base 1 over the entire width of the base 1.

Figure 6:
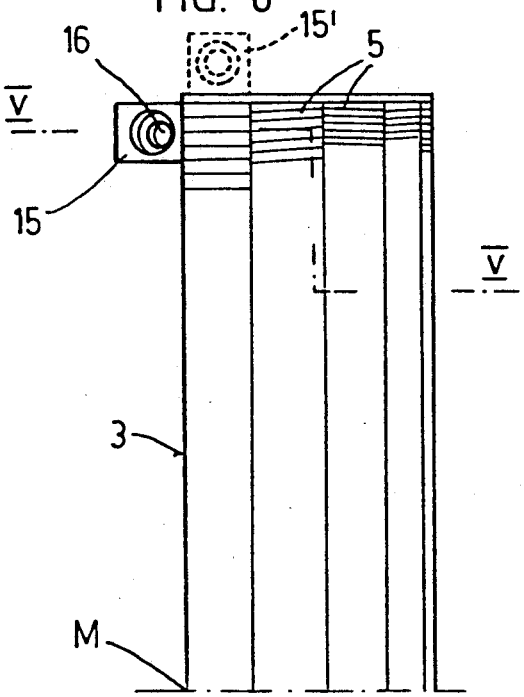
FIG. 6 illustrates a plan view of the comb segment of FIG. 5.

Referring to FIGS. 5 and 6, wherein like reference characters indicate like parts as above, the circular comb segment is provided with a lug 15 at each side with a bore 16 extending through each lug 15 for passage of a fixing screw (not shown) therethrough into the circular comb roller R. As indicated in solid line, each lug 15 may project forwardly from the front edge 3 such that the free space is defined between the lugs 15. That is, the free space in front of the plane E extends in the middle region of the width of the base 1 over the entire thickness of the base 1 from the middle M up to the two lugs 15. In this case, the free space is equivalent to at least 80% and preferably at least 90% of the width of the base 1. Alternatively, as indicated in dotted lines, each lug 15, may project laterally of the base 1, that is, behind the plane E. In this case, the free space extends completely across the front edge 3.

Figure 7:
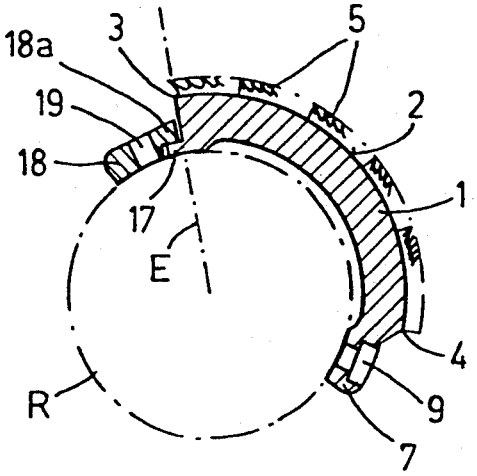
FIG. 7 illustrates a further modified comb segment in accordance with the invention taken on line VII—VII of FIG. 8.
Figure 8:
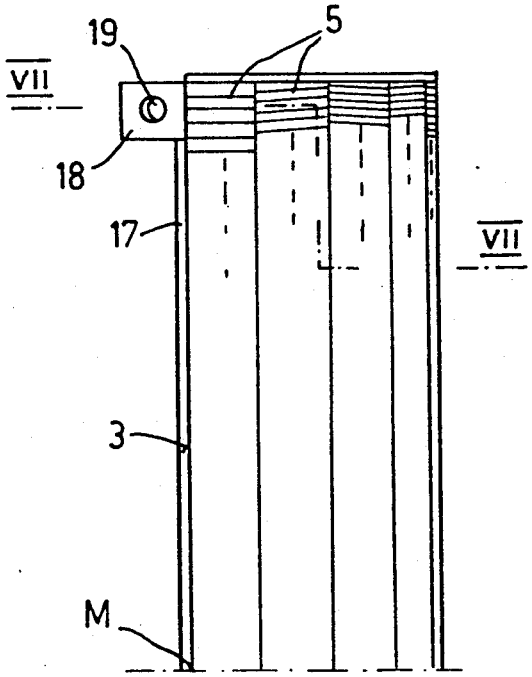
FIG. 8 illustrates a plan view of the comb segment of FIG. 7.

Referring to FIGS. 7 and 8, wherein like reference characters indicate like parts as above, the circular comb segment may be provided with a projection or lip 17 which extends from the front edge 3 of the base 1 over the entire width of the base 1 so that the base 1 can be made by drawing. In this case, a clamping means is provided for engaging the projection (lip) 17 to secure the segment to the comb roller R. As indicated, the clamping means may be in the form of a pair of clamping plates 18 disposed at a respective side of the segment to define a free space therebetween. In addition, each clamping plate 18 has a bore 19 to receive a fixing screw (not shown) for threading into the comb roller R and a lug 18*a* which engages the projection 17 against the roller R.

As indicated by FIG. 8, the free space in front of the plane E of the front edge 3 extends from the middle region M to the clamping plates 18 while extending radially from the front edge 3 as far as the projection 17. Since the height of the projection 17 is relatively small, the free space extends over most of the thickness of the base 1, that is, over at least approximately 75% to 80% of the total thickness of the base 1. In this respect, the radial distance from the front edge 3 as far as the projection 17 should be at least 10 millimeters and preferably at least 12 millimeters. The middle zone of the width of the base 1 again extends over at least 80% to 90% of the entire width of the base 1.

Figure 9:
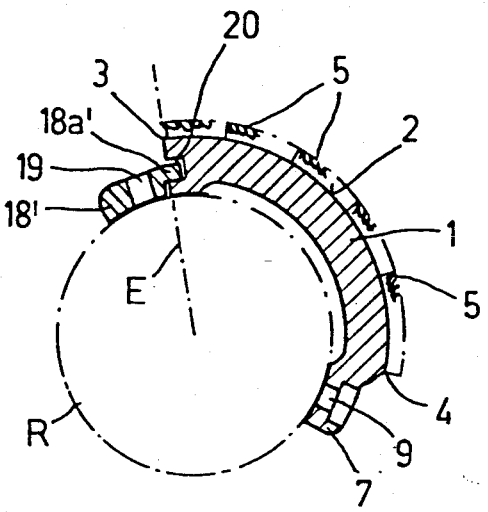
FIG. 9 illustrates a further modified comb segment and clamping means taken on line IX—IX of FIG. 10 in accordance with the invention.
Figure 10:
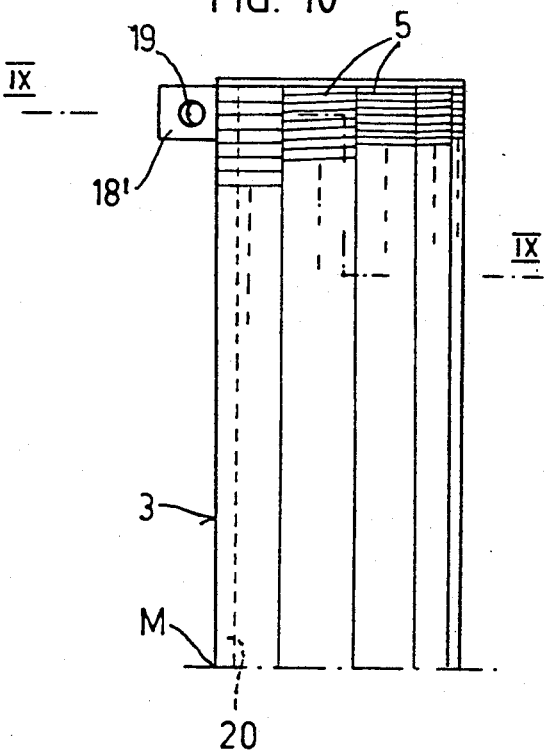
FIG. 10 illustrates a plan view of the comb segment of FIG. 9.

Referring to FIGS. 9 and 10, wherein like reference characters indicate like parts as above, the base 1 may be provided with a recess 20 in the front face so that a projection (lip) 17 extends rearwardly of the plane E. In this respect, the projection 17 forms a wall of the recess 20. In addition, each clamping lug 18*a*′ of a clamping plate 18, projects into the recess 20. The free space in front of the plane E thus ends in the middle zone of the base 1 between the two clamping plates 18′ radially from the front edge 3 over the entire thickness of the base 1.

Figure 11:
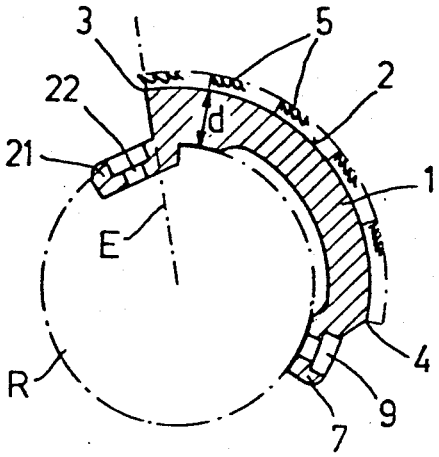
FIG. 11 illustrates a cross sectional view of a further modified comb segment in accordance with the invention taken on line XI—XI of FIG. 12.
Figure 12:
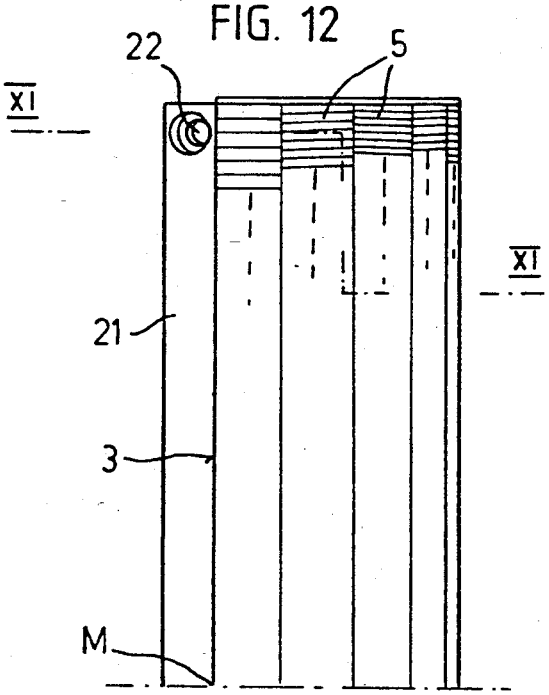
FIG. 12 illustrates a plan view of the comb segment of FIG. 11.

Referring to FIGS. 11 and 12, wherein like reference characters indicate like parts as above, the segment may have a projection 21 which extends from the front edge 3 which is offset radially inwardly of the front edge 3 for positioning in a recess of the comb roller R. As illustrated, the projection has a bore 22 at each end to receive fixing screws (not shown) for fixing the segment to the comb roller R. As indicated, the projection 21 is continuous over the entire width of the base 1. The free space in front of the plane E extends radially over at least 80% and preferably at least 90% of the thickness D of the base 1 measured behind the projection 21. The radial distance from the front edge as far as the projection 21 should be at least 10 millimeters and preferably at least 12 millimeters.

The invention thus provides a comb segment in which the foremost needles or clothing points at the front edge are able to receive a tuft without a fixing strip interfering with the combing action of these needles or points. In this respect, the front edge of the combing segment is provided with a free space which extends over a substantial width and height of the front edge so that a tuft is not deflected away from the foremost needles or clothing points. Accordingly, the comb segment is readily suitable for rotating on a comb roller at speeds of up to 300 rpm to comb laps having relatively large weights, for example, weights up to 230 grams per square meter, that is, up to about 4.5 grams lap per minute per centimeter width of the circular comb.

What is claimed is:

1. A circular comb segment for fixing on a circular comb roller of a combing machine, said segment including a base having an outer cylindrical peripheral surface extending from a front edge to a rear edge and having either combing needles or clothing points extending from said front edge, said base having a front face and a free space in a peripheral direction in front of a plane passing through the axis of said peripheral surface, coplanar with said front face and through the foremost needles or clothing points, said free space extending radially from said front edge over the entire thickness of said base and extending in the direction of the width of said base from the middle of said front edge to both sides over at least the major part of the width of said base.

2. A circular comb segment as set forth in claim 1 wherein said free space extends radially from said front edge over at least 10 millimeters.

3. A circular comb segment as set forth in claim 1 wherein said free space extends over at least 80% of the width of said base.

4. A circular comb segment as set forth in claim 1 wherein said free space extends over the entire width of said base.

5. A circular comb segment for fixing on a circular comb roller of a combing machine, said segment including a base having an outer cylindrical peripheral surface extending from a front edge to a rear edge and having either combing needles or clothing points extending from said front edge to said rear edge, said base having a front face coplanar with a plane passing through said front edge and an axis of said peripheral surface, said base having a free space in front of said plane, a recess at each side adjacent said front face and a bore extending through each recess for passage of a fixing screw therethrough into a circular comb roller.

6. A circular comb segment for fixing on a circular comb roller of a combing machine, said segment including a base having an outer cylindrical peripheral surface extending from a front edge to a rear edge and having either combing needles or clothing points extending from said front edge to said rear edge, a front face coplanar with a plane passing through said front edge and an axis of said peripheral surface, said base having a free space in front of said plane, a lug at each side adjacent said front face and a bore extending through each lug for passage of a fixing screw therethrough into a circular comb roller.

7. A circular comb segment as set forth in claim 6 wherein each lug projects forwardly from said front face to define a free space therebetween.

8. A circular comb segment as set forth in claim 6 wherein each lug projects laterally of said base.

9. A circular comb segment for fixing on a circular comb roller of a combing machine, said segment including a base having an outer cylindrical peripheral surface extending from a front edge to a rear edge for receiving either combing needles and a clothing thereon, or a card projection extending from said front edge and being offset radially inwardly of said front edge for positioning in a recess of a circular comb roller, said projection having at least one bore for passage of a fixing screw therethrough into the roller.

10. In combination, a circular comb segment including a base having an outer cylindrical peripheral surface extending from a front edge to a rear edge for receiving either combing needles or a card clothing thereon and a lip at said front edge; and clamping means for engaging said lip at said front edge to secure said segment to a circular comb roller of a combing machine, said clamping means including a pair of laterally spaced apart clamping plates, each said plate being disposed at a respective side of said segment to define a free space therebetween.

11. The combination, as set forth in claim 10 wherein said lip projects forwardly from said front edge.

12. The combination as set forth in claim 10 wherein said base has a recess adjacent said lip at said front edge and each said clamping plate has a lug projecting into said recess.

13. The combination as set forth in claim 12 wherein each said plate has a bore for passage of a fixing screw therethrough into a circular comb roller.

14. The combination as set forth in claim 10 wherein said front edge is disposed in a radial plane of the combing roller.

15. A circular comb segment for fixing on a circular comb roller of a combing machine, said segment including a base having an outer cylindrical peripheral surface extending from a front edge to a rear edge and having either combing needles or clothing points extending from said front edge to said rear edge, a lug at each side adjacent said front edge and projecting forwardly from said front edge to define a free space between said lugs and a bore extending through each lug for passing of a fixing screw therethrough into a circular comb roller.

* * * * *

UNITED STATES PATENT AND TRADEMARK OFFICE

CERTIFICATE OF CORRECTION

PATENT NO. : 5,109,574

DATED : May 5, 1992

INVENTOR(S) : HANSULRICH EICHENBERGER

It is certified that error appears in the above-identified patent and that said Letters Patent is hereby corrected as shown below:

Column 2, line 53 after "is" insert -located-

Signed and Sealed this

Nineteenth Day of October, 1993

*Attest:*

*Attesting Officer*

Bruce Lehman

BRUCE LEHMAN

*Commissioner of Patents and Trademarks*